United States Patent [19]

Borries et al.

[11] Patent Number: 4,620,449

[45] Date of Patent: Nov. 4, 1986

[54] PORTABLE AIR TOOL HAVING BUILT IN TRANSDUCER AND CALIBRATION ASSEMBLY

[75] Inventors: John A. Borries, Chardon; Earl E. Rush, Mentor; William S. Washeim, Seven Hills, all of Ohio

[73] Assignee: The Rotor Tool Company, Cleveland, Ohio

[21] Appl. No.: 726,061

[22] Filed: Apr. 23, 1985

[51] Int. Cl.[4] ..... B25B 23/145

[52] U.S. Cl. ..... 73/862.21; 73/862.31

[58] Field of Search ..... 73/862.21, 862.23, 862.31, 73/862.35, 1 C, 1 B

[56] References Cited

U.S. PATENT DOCUMENTS 4,281,538 8/1981 Dudek ..... 73/862.31 X 4,286,458 9/1981 Alexander ..... 73/862.21

OTHER PUBLICATIONS

Instruments & Automation, vol. 31, No. 3, Mar. 1958, pp. 447–454.

*Primary Examiner*—Charles A. Ruehl

*Attorney, Agent, or Firm*—Renner, Otto, Boisselle & Lyon

[57] ABSTRACT

A portable air tool for applying torque to a workpiece includes a built in strain gauge transducer for measuring applied torque and a built in potentiometer adjustment mechanism for balancing or calibrating the transducer in unloaded condition. The transducer and potentiometer adjustment mechanism are electrically connected by leads passing from the tool to an electrical circuit containing the power supply and a millivolt meter or computer. To balance the transducer in unloaded condition, the end of a screwdriver or other tool may be inserted through a housing aperture and into the air tool to turn an adjustment screw on the enclosed potentiometer until the millivolt meter reads zero indicating balance in the transducer circuit. Alternatively, the potentiometer could be mounted in a threaded sleeve forming the handle of the tool, with adjustment access to the potentiometer being provided when the handle is unthreaded and axially moved relative to the tool to expose the potentiometer.

15 Claims, 6 Drawing Figures

PORTABLE AIR TOOL HAVING BUILT IN TRANSDUCER AND CALIBRATION ASSEMBLY

FIELD OF THE INVENTION

The present invention relates in general to portable air tools having built in transducers and in particular to an air tool including a built in calibration assembly permitting the transducer to be balanced in its unloaded condition at the work station.

BACKGROUND OF THE INVENTION

Portable air tools having built in transducers are well known in the industry and are often used, for example, as nut runners in monitored production lines. An example of an angle nut runner with built in torque transducer is shown in U.S. Pat. No. 3,858,444.

Nut runners with built in transducers are frequently used in automobile production lines. These air tools with built in transducers are coupled to a centralized computer to monitor and record torque applied to each fastener for each car by serial number. This monitored and recorded information provides a useful data base for quality control and maintenance purposes.

The reliability of this data is dependent upon the transducer circuit being in a balanced condition when unloaded to provide a constant and predictable frame of reference for measuring torque applied. However, the strain gauge elements in the transducer circuit tend to change impedance over use and time. This change in impedance is not necessarily uniform for the strain gauge elements forming the built in transducer resulting in the transducer drifting in value from its original zero or balanced reference condition. This drift or change in the balanced or reference condition of the transducer circuit has been recognized and can be corrected to a certain extent by computer programming compensating for such drift electronically to establish the correct balanced condition to provide reliable and comparative output data. Unfortunately, the extent of drift or change in the respective transducer strain gauge elements may exceed in value the computer system's capacity for accurate correction. In such case, the computer issues an error signal for the transducer of the affected tool requiring that the transducer be corrected or replaced before further use of the tool.

This problem normally requires the tool to be removed from the production line and returned either to the maintenance shop at the plant or to the transducer manufacturer. This remote maintenance on the transducer is ineffecient and expensive.

SUMMARY OF THE INVENTION

To avoid remote maintenance, the present invention provides a portable air tool having a built in calibration device for the built in transducer. Therefore, the principal object of the present invention is to provide a transducer balancing device in the air tool housing which may be readily and accurately adjusted at the work station to balance the transducer circuit.

It is another object of the invention to permit a hand tool selectively to be inserted through an aperture in the housing of the air tool to turn an adjustment screw on an enclosed potentiometer in the transducer circuit to balance the transducer circuit to zero for the unloaded condition. To this end, the potentiometer is mounted on a splined torque body allowing the torque body to be easily mounted in the tool housing and allowing the potentiometer to be readily aligned with the housing aperture.

It is yet another object of the present invention to mount the adjustable potentiometer in a sleeve threadly connected to the tool body to form the handle of the tool. Unthreading and axially sliding the handle sleeve provides ready access to the potentiometer to balance the transducer circuit to zero.

These and other objects and advantages of the present invention will become apparent as the following description proceeds.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principle of the invention may be employed.

Figure 1:
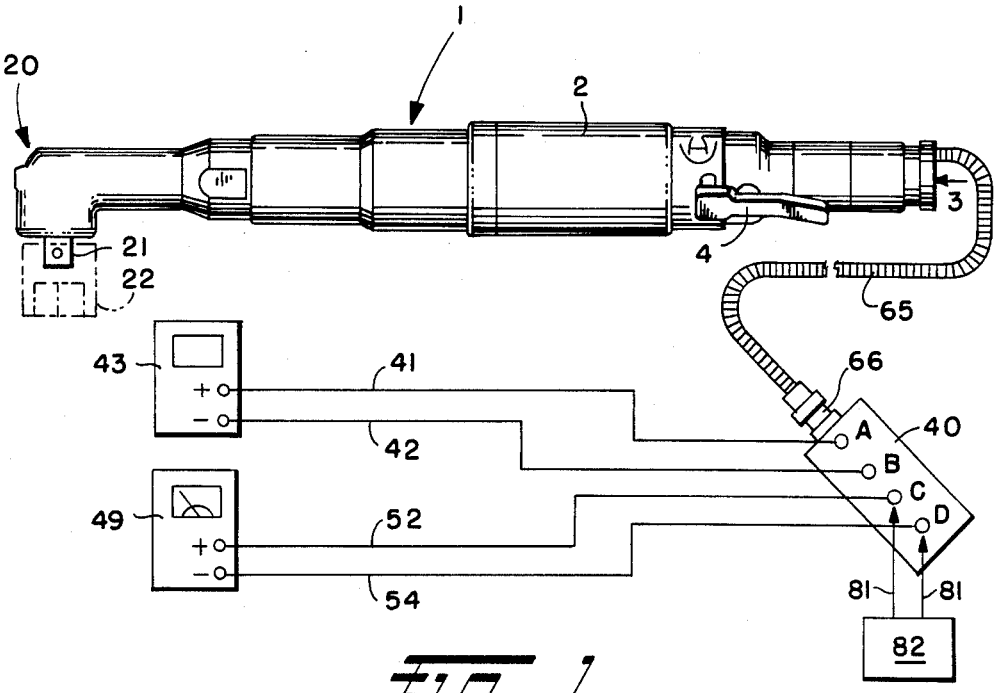
FIG. 1 is an elevation of a right angle nut runner provided with the built in transducer and calibration assembly of the present invention schematically showing the power supply, junction box, millivolt meter and related electrical lead lines.
Figure 2:
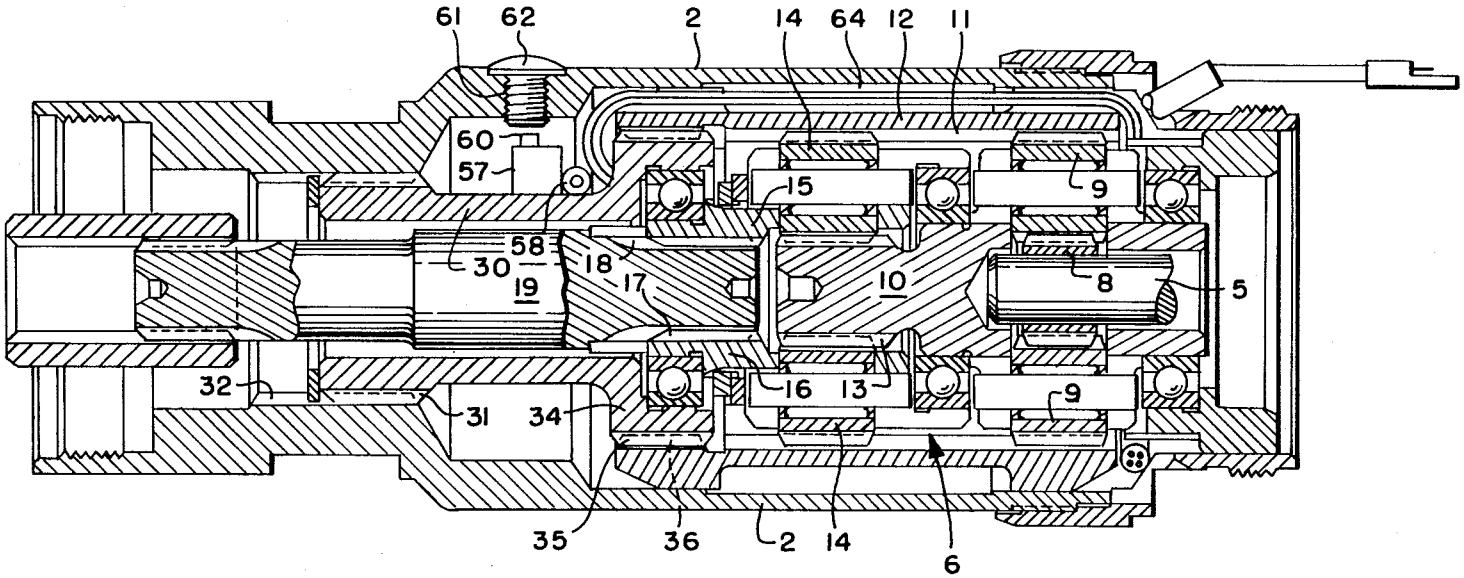
FIG. 2 is a vertical cross section of the right angle nut runner of FIG. 1 showing the gear reduction assembly, the transducer body and the adjustable potentiometer in alignment with an aperture in the tool housing.

Turning now in more detail to the drawings and initially to FIGS. 1 and 2, a portable air tool indicated generally at 1 has a housing 2. As shown, the air tool 1 is a right angle nut runner but other air tools are contemplated by the present invention. The tool housing 2 has an air inlet 3 to drive a conventional air motor (not shown) contained within the housing. The tool 1 has a throttle valve 4 on the handle section of tool 1. The throttle valve may be selectively activated by depression to energize the motor to rotate the air motor in conventional fashion. This motor rotation in turn rotates forwardly extending motor output shaft 5. This output shaft 5 rotates a high rpm and low torque, and this is converted to lower rpm and higher torque by the speed reduction assembly indicated generally at 6. As shown, the speed reduction assembly has two stages but this is exemplary only.

The speed reduction assembly 6 includes a sun gear 8 mounted on motor output shaft 5. The teeth of sun gear 8 are in mesh with the respective teeth of a plurality of circumferentially spaced planetary gears 9 rotatably carried by a first planetary gear carrier 10. Each of the planetary gears 9 has its teeth in mesh with the internal teeth 11 on ring gear 12. As will be described in detail hereinafter, this ring gear 12 is indirectly secured in cantilever relationship to the housing but may rotate slightly in reactive response to torque applied.

The two stage speed reducer assembly 6 further includes a second sun gear 13 extending forwardly from and integrally formed with the first planetary gear carrier 10. The second sun gear 13 has its teeth in mesh with the teeth on a plurality of circumferentially spaced planetary gears 14 of a second planetary gear set. The planetary gears 14, which are rotatably carried in a second planetary gear carrier 15, also have their teeth in mesh with the internal teeth 11 on ring gear 12.

The second planetary gear carrier 15 includes a forwardly projecting socket 16 having parallel, longitudinally extending splines 17 on its inner diameter. Splines 17 interfit with external splines 18 on rotatable output shaft 19. The output shaft 19 is thus driven by the motor and two stage gear reduction assembly 6 at lower rpm and higher torque.

Output shaft 19 is coupled to a right angle drive indicated generally at 20 to rotate a square shape drive head 21. A socket 22 may releasably be secured to head 21, with such socket being selected to have an internal configuration complimenting the configuration of the received fastener head to transmit torque from the tool to the fastener. The torque thus applied to the fastener is measured and monitored by the transducer circuit of the present invention.

Figure 3:
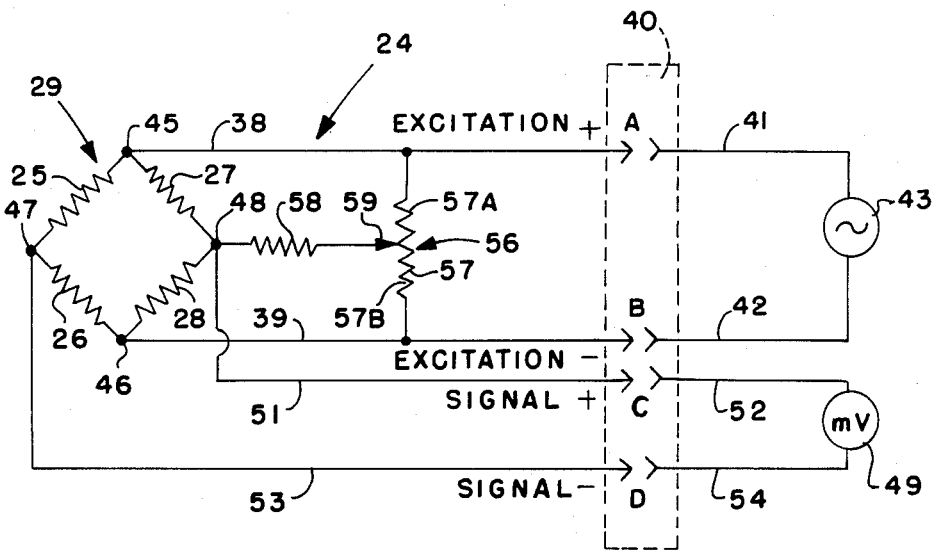
FIG. 3 is the transducer and calibration circuit of the present invention.

As best shown in FIGS. 2 and 3, the transducer circuit indicated generally at 24 includes four strain gauge resistors 25, 26, 27 and 28 respectively arranged on the four sides of a Wheatstone Bridge circuit 29. The strain gauge resistors may be 700 Ω each and may be mounted on the outer diameter of cylindrical torque body 30. These four strain gauge resistors are spaced in 90° circumferential increments about cylindrical torque body 30. Strain gauge resistor 25 is diametrically opposed to or 180° from strain gauge resistor 27, and strain gauge resistor 26 is diametrically opposed to strain gauge 28. Alternatively, these strain gauge resistors may be configured in four circumferentially spaced pairs of reistors having a resistance of 350 Ω per resistor. These resistors and leads are mounted on the forward end of the cylindrical surface of body 30 and are encapsulated in suitable sealant.

The cylindrical strain gauge body 30 has parallel longitudinally extending splines 31 circumferentially about the outer diameter of its forwardly extending end. These splines 31 interfit with and bear against longitudinally extending parallel splines 32 on the inside diameter of housing body 2. Splines 31 and 32 thus rotationally fix the forward end of cylindrical torque body 30 to the housing while permitting axial movement therebetween for assembly and maintenance purposes.

The other end of cylindrical torque body 30 has an enlarged annular flange 34 provided with a plurality of parallel, longitudinally extending splines 35 on its outer diameter. These splines 35 receive and engage longitudinally extending splines 36 on the inner diameter of the forward end of ring gear 12. The splined interconnection between the cylindrical torque body 30 and ring gear 12 precludes relative rotation therebetween while permitting axial movement therebetween for assembly and maintenance purposes. The splined interconnection between cylindrical torque body 30 and ring gear 12 normally restrains ring gear 12 from rotation because body 30 is secured to the housing. However, as the torque load increases in air tool operation, the ring gear 12 reacts by slight turning movement to twist the cylindrical torque body 30 around its splined cantilever mount from housing 2. This twist or flexure in the cylindrical torque body 30 is measured and monitored by the transducer circuit 24.

Referring now to FIG. 3, the electrical input to Wheatstone Bridge circuit 29 is provided along positive line 38 and negative line 39 connected respectively at terminals A and B of junction box 40 to lead lines 41 and 42 connected to power supply 43. The power supply may be, for example, a battery, a D.C. power supply or a high frequency AC source. The power source 43 provides via the positive input excitation lines 38 and 41 and the negative input lines 39 and 42 a DC voltage across the nodes 45 and 46 of the bridge circuit 29.

The nodes 47 and 48 are connected to an output device 49. This electrical connection is made by positive output line 51 extending from node 48 to a selectively removable connection to terminal C of junction box 40, which in turn is connected by line 52 to output device 49. Node 47 of bridge circuit 29 is connected by the negative output signal line 52 to a selectively removable connection to terminal D of junction box 40, which in turn is connected by line 54 to output device 49. As shown, the output device 49 is a conventional millivolt meter to indicate the output voltage. This millivolt meter is used in balancing the bridge circuit in the unloaded or static condition of power tool 1.

To this end, a calibration device or assembly, indicated generally at 56, is provided to balance the transducer circuit. The calibration device 56 includes a potentiometer 57 (or variable resistor) mounted on and extending radially outwardly from the cylindrical torque body 30. This adjustable potentiometer 57 is connected across power input lines 38 and 39 and may have a 100KΩ resistance. A fixed shunt resistor 58, of 449 KΩ, is connected between the node 48 on bridge circuit 29 and a movable wiper 59 of the potentiometer 57. The wiper 59 may be selectively moved along the potentiometer 57 by turning an adjustment screw 60 (FIG. 2) on potentiometer 57. The resistance values of the shunt resistor and adjustable potentiometer are selected to provide linearity of output and a reasonable adjustment range, with the relative values specified herein exemplifying a relationship of circuit elements providing the desired functions.

As best shown in FIG. 2, the screw 60 on potentiometer 57 is in radial alignment with a tapped aperture 61 in housing 2. A plug 62 having a threaded shank is normally threadedly received in tapped aperture 61 fully to enclose the adjustment screw 60 and potentiometer 57. However, an exhaust hole in the housing might also be used as the access to the potentiometer. In such case, the exhaust hole obviously would not be covered by a plug.

As shown in FIG. 2, the input and output electrical lines extend from the strain gauges, potentiometer and shunt resistor through a longitudinal passage 64 in the housing 2 to pass from the tool into a cable 65. This cable 65 is connected at 66 to the junction box 40 to complete the circuit shown in FIG. 3.

The operation of the air tool having built in transducer and calibration device as just described will now be described for both the normal operating mode and for the calibration or balancing mode.

In normal operation, lines 52 and 54 would be disconnected from the junction box to remove the millivolt meter 49 from the circuit. Lines 80 and 81 from a central computer 82 would be connected to terminals C and D for monitoring and recording the torque applied to each fastener by air tool 1. After the work socket 22 of the tool is engaged with the fastener to be tightened, the throttle valve 4 is manually depressed causing pressurized air to enter the tool at inlet 3 to operate the motor in a work tightening direction. The torque of the motor is transmitted from the output shaft 5 to the two stage gear reduction 6. As a consequence, the peripheral planetary idler gears 9 and 14 of the first and second stages of the reduction gearing rotate relative to the restrained ring gear 12 to cause rotation of the first and second planetary gear carriers 10 and 15. Rotation of the gear carriers is transmitted through drive spindle 19 and right angle drive 20 to the work socket to torque the fastener. Torque in continually applied to the fastener until the resistance of the fastener exceeds a preselected torque of the motor for the fastener being made up.

The reaction torque developed in turning the fastener is passed from the fastener through drive spindle 19, the planetary gear carriers and idle gears to the ring gear 12. This results in the ring gear 12 rotating slightly causing the ring gear to exert a reaction torque force upon cylindrical torque body 30. This reaction torque force results in some strain on or twisting of the cylindrical transducer body 30 mounted in cantilever relation to housing 2. This twist of the cylindrical housing body 30 is in a reverse direction to the drive direction. In response to this twisting, all of the strain gauges will progressively change in resistance proportionately to the amount of deflection. This provides a changing output voltage in the output circuit reflecting torque magnitude and polarity depending upon direction of the strain. This output information is stored by computer 82 to provide a record of torque applied to each fastener tightened on the production line.

When the fastener has been tightened and the torque released, the impedances of the respective strain gauges normally return to their typical resistances to provide a balanced circuit having a zero voltage output. Unfortunately, the strain gauge elements tend to change impedance over use and time such that upon removal of the strain input the impedance of a given strain gauge element may not return to the nominal or initial value it had earlier in its life. If such impedance drifting were uniform for all four strain guage elements in the bridge 29, the drifting process would not affect output or operation of the transducer circuit 24. However, such impedance drifting is not the same for each strain gauge element and this non-unformity may result in an improperly offset reference point causing inaccurate output information at the output device.

The computer 82 is provided with programming automatically to take circuit readings in an unloaded condition and to compensate for any variance in bridge impedance drift detected through program routines. However, the variance detected may exceed the capacity of the computer correction routine requiring recalibration or rebalancing before use.

Figure 2A:
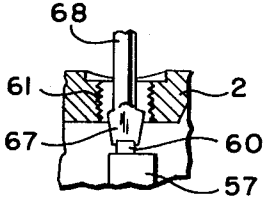
FIG. 2A is a fragmentary section showing the shank of a screwdriver inserted into the air tool to turn the adjustment screw of the potentiometer to balance the transducer circuit in unloaded condition.

With the present invention, this rebalancing may be done in line at the work station through a simple adjustment procedure. To this end, the lead lines 80 and 81 from the computer 82 are disconnected from terminals C and D of junction box 40. A millivolt meter 49 is then connected to junction box 40 by lead lines 52 and 54. This millivolt meter 49 is at the work station immediately adjacent tool 2. With the millivolt meter in place, the plug 62 is removed from aperture 61 in housing 2 to provide direct radial access to adjustment screw 60 on potentiometer 57. As best shown in FIG. 2A, the head 67 and shank 68 of a screwdriver are passed through the aperture 61 in housing 2. The screwdriver head 67 is received in the groove of adjustment screw 60, and such screw is then turned to move wiper 59 along potentiometer resistor 57. Potentiometer resistor 57 has two portions 57A and 57B connected in parallel with the respective strain gauge element pairs 25, 26 and 27, 28 across lines 38 and 39. To understand the adjustment of such potentiometer, the normal or balanced mode will be described followed by the adjustment mode to bring the transducer back into balance.

When the impedance, oridinarily expected to be resistance, of each of the elements 25 through 28, 57A and 57B is the same, the voltage level of each of the nodes 47 and 48 and the point of connection of the wiper 59 to the potentiometer 57 will all be the same. Accordingly, the voltage drop across the resistor portions 57A and 57B of the potentiometer will have no influence on the output signal produced on lines 51 and 53. Indeed, the output device 49 would be expected to indicate a zero output.

On the other hand, if the zero strain impedance value of one of the strain gauge elements were different from the others, there would tend to be an imbalance in the bridge 29 at the zero strain condition, which would show upon the output device 49. To eliminate such imbalance condition, the wiper arm 59 of the potentiometer can be adjusted by using the screwdriver to turn the adjustment screw 60 and monitoring the effect of the same on the millivolt meter 49. The adjustment screw 60 would be turned until the output device 49 again reads the zero output condition. Thus, in so turning the adjustment screw 60, the voltage level of the wiper 59 relative to node 48 is changed whereupon any current flowing the bridge 29 would be effected to cause the voltages at the nodes 47 and 48 to return back to the same reference values so that the voltage across lines 51 and 53 to the output device 49 will be zero. With the bridge 29 thus balanced or calibrated, the screwdriver is removed from the housing and the plug 62 is threaded back into position. The millivolt meter 49 is then removed from the junction box and the circuit is again electrically coupled to the computer for continued operation.

Figure 4:
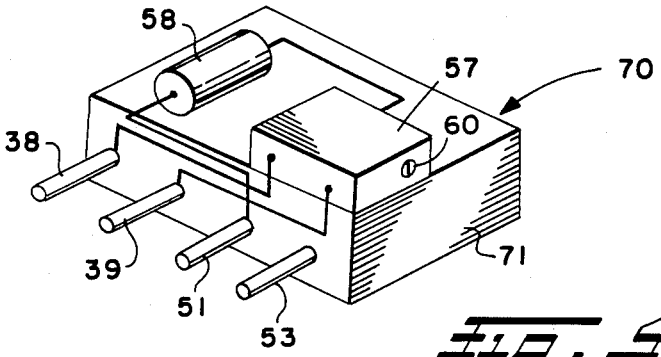
FIG. 4 is a perspective view of the potentiometer module of an alternative embodiment.
Figure 5:
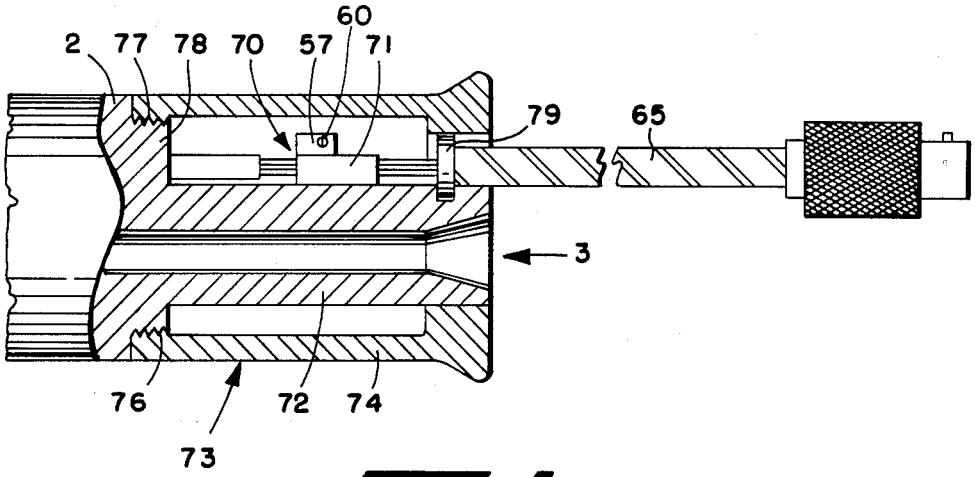
FIG. 5 is a fragmentary elevation partially in section showing the potentiometer module of FIG. 4 mounted in the sleeved handle of the second embodiment.

An alternative second embodiment of the present invention is shown in FIGS. 4 and 5 in which the potentiometer is mounted in the handle instead of one the torque body 30 as in the first embodiment. The other structure in the second embodiment is substantially the same as the structure in the first embodiment, and common reference numerals have been used for both embodiments as appropriate.

As best shown in FIG. 4, the potentiometer module 70 includes a module body 71 on which the potentiometer 57 and shunt resistor 58 are mounted. The lead 38, 39, 51 and 53 are connected to the module body 71 for electrical circuit connection with the potentiometer and shunt resistor as indicated in FIGS. 3 and 4.

The potentimeter module 70 is mounted on the outside diameter of the annular wall 72 defining the air intake 3 for tool 1, with wall 72 being integrally formed with housing 2. The input and output lines 38, 39, 51 and 53 extend from module 70 through passage 64 in tool 1 to the strain gauges mounted on cylindrical torque body 30. The lead lines enclosed in cable 65 are connected to the other side of module 70 and extend from the tool handle to the junction box 40.

The tool handle, indicated generally at 73, is formed by a tubular sleeve 74. The inner diameter on the forward end of sleeve 74 is threaded as shown at 76. The sleeve threads 76 selectively cooperate with the male threaded section 77 on shoulder 78 of tool body 2. When the sleeve is threaded in place to form the handle, the potentiometer module and related leads are enclosed and protected. These leads are stabilized by a strain relief collar 79 mounted on annular wall 72 to maintain the electrical connection integrity.

When it becomes necessary to rebalance the transducer circuitry, the sleeve 74 is rotated to withdraw the threaded connection. The sleeve 74 is then free from the body and can be axially slid away from the body along cable 65 to expose the potentiometer module 70. The balancing adjustment can then be readily made by turning the accessed potentiometer adjustment screw 60 as described above.

The second embodiment provides normal enclosure of the potentiometer and on site balancing adjustment and can be used with any type of torque flexure body since alignment between the poteniometer and a tool body aperture is not an assembly criterion. Therefore, the second embodiment can be used to retrofit existing tools having transducer with an on-site balancing capability and can also be used for original equipment manufacture.

The built in transducer and built in calibration device of the present invention provide easy and efficient recalibration or balancing of the air tool transducer at the work station. The built in transducer and calibration device are enclosed to avoid contamination, damage and inadvertent and unwanted changes in the circuit balance.

It will be apparent from the foregoing that changes may be made in the details of construction and configuration without departing from the spirit of the invention as defined in the following claims.

We claim:

1. A portable air tool with built in transducers and calibration assembly comprising a housing, a motor in the housing having an output shaft, a gear reduction assembly coupled to the motor output shaft to transmit torque to a workpiece, said gear reduction assembly including a ring gear, a torque body having a splined connection at one end to the housing and a splined connection of the other end to the ring gear, a transducer and calibration assembly mounted on said torque body in said housing and including input and output lead lines passing from the housing to an electrical circuit containing a power supply and an output monitoring device, said housing having an aperture in alignment with the contained calibration assembly selectively allowing access to the enclosed calibration assembly to permit the transducer to be balanced in unloaded condition by adjusting the calibration assembly until a balanced condition is displayed on the output monitoring device.

2. The air tool of claim 1 wherein the calibration assembly includes a potentiometer having an adjustment screw selectively to move a wiper along the potentiometer.

3. The air tool of claim 2 wherein a tool is inserted into the housing aperture to turn the adjustment screw to move the wiper along the potentiometer until circuit balance is obtained.

4. The air tool of claim 3 wherein the housing aperture is tapped and normally receives a threaded plug to close the aperture.

5. The air tool of claim 3 wherein the transducer includes four strain gauges connected in a Wheatstone Bridge with the strain gauges being connected to the torque body in 90° increments, with the opposed strain gauges in the bridge circuit being diametrically opposed from one another on the torque body.

6. The power tool of claim 5 wherein the power supply is connected to the first and second opposed nodes of the Wheatstone Bridge by the input lead lines and the third and fourth opposed nodes of the Wheatstone Bridge are connected to the output monitoring device by the output lead lines.

7. The power tool of claim 6 wherein the potentiometer is connected across the input lead lines and a shunt resistor is connected between either the third or fourth node and the movable wiper of the potentiometer.

8. The portable air tool of claim 7 further including a junction box adjacent the tool provide terminals selectively to couple a cable containing the input and output lead lines from the tool to the power supply and output monitoring device.

9. The portable air tool of claim 8 wherein the output monitoring device for balancing the transducer when the tool is in an unloaded condition is a millivolt meter.

10. The portable air tool of claim 8 wherein the output monitoring device for normal tool operation is a computer.

11. A portable air tool with built-in transducer and calibration assembly comprising a housing, a motor in the housing having an output shaft, a gear reduction assembly coupled to the motor output shaft to transmit torque to a workpiece in loaded condition, said gear reduction assembly including a ring gear, a torque body connected at one end to the housing and connected at the other end to the ring gear, a transducer mounted on the torque body, a calibration assembly mounted in the housing, input and output leads connected to said torque body and calibration assembly and passing from the housing to form an electrical circuit with a power supply and an output monitoring device, and access means selectively to provide access to the normally enclosed calibration assembly to permit the transducer to be balanced in unloaded condition by adjusting the calibration assembly until a balanced condition is displayed on the output monitoring device.

12. The portable air tool of claim 11 wherein said access means comprises an aperture in the tool housing in alignment with the calibration assembly.

13. The portable air tool of claim 12 wherein the aperture is normally closed and the calibration assembly is mounted on the torque body.

14. The portable air tool of claim 11 wherein said access means comprises a handle sleeve threaded to the housing and said calibration assembly is mounted on the tool housing inside said sleeve.

15. The portable air tool of claim 14 wherein said handle sleeve may be unthreaded from said housing and slid relative to the housing to expose the normally enclosed calibration assembly.

* * * * *